US009506649B2

(12) United States Patent
Rennie et al.

(10) Patent No.: US 9,506,649 B2
(45) Date of Patent: Nov. 29, 2016

(54) METHODS AND APPARATUS TO CONTROL COMBUSTION PROCESS SYSTEMS

(71) Applicant: Fisher-Rosemount Systems, Inc., Round Rock, TX (US)

(72) Inventors: John Duncan Rennie, Austin, TX (US); Scott Rusheon Pettigrew, Austin, TX (US); Barbara Kerr Hamilton, Garrison, NY (US); Andrea Nicole Bishop, Roswell, GA (US)

(73) Assignee: FISHER-ROSEMOUNT SYSTEMS, INC, Round Rock, TX (US)

( * ) Notice: Subject to any disclaimer, the term of this patent is extended or adjusted under 35 U.S.C. 154(b) by 554 days.

(21) Appl. No.: 13/892,568

(22) Filed: May 13, 2013

(65) Prior Publication Data

US 2013/0302738 A1 Nov. 14, 2013

Related U.S. Application Data

(60) Provisional application No. 61/645,972, filed on May 11, 2012.

(51) Int. Cl.
*G01N 35/02* (2006.01)
*F23N 1/02* (2006.01)

(52) U.S. Cl.
CPC ..... *F23N 1/022* (2013.01)

(58) Field of Classification Search
None
See application file for complete search history.

(56) References Cited

U.S. PATENT DOCUMENTS 4,576,570 A * 3/1986 Adams ..... F23N 1/022 236/15 BD
2007/0100502 A1 5/2007 Rennie, Jr. et al.
2011/0212404 A1* 9/2011 Fan ..... F23N 1/022 431/12

FOREIGN PATENT DOCUMENTS

GB 2298059 8/1996
GB 2298294 8/1996

OTHER PUBLICATIONS

Search Report, issued by the United Kingdom Intellectual Property Office in connection with GB Patent Application No. GB1308470.2, on Dec. 3, 2013, pp. 1-3.

* cited by examiner

*Primary Examiner* — Robert Xu
(74) *Attorney, Agent, or Firm* — Hanley, Flight & Zimmerman, LLC

(57) ABSTRACT

Example methods and apparatus to control combustion process systems are disclosed. An example method includes monitoring an actual flow of fuel into a combustion process, calculating a relative heat release value corresponding to the fuel in the combustion process, and determining a fuel demand for the combustion process based on the relative heat release value.

11 Claims, 11 Drawing Sheets

300

| Percent Oxygen | Excess Air (% of Total) |
|---|---|
| 0 | 0 |
| 1 | 4.9 |
| 2 | 10.5 |
| 3 | 17.5 |
| 4 | 24.5 |
| 5 | 32.5 |
| 6 | 40.5 |
| 7 | 49.5 |
| 8 | 59.9 |
| 9 | 71 |
| 10 | 85 |
| 10.5 | 95 |

302

METHODS AND APPARATUS TO CONTROL COMBUSTION PROCESS SYSTEMS

RELATED APPLICATION

This patent arises from a non-provisional application of Provisional U.S. Application Ser. No. 61/645,972, which was filed on May 11, 2012, and which is hereby incorporated herein by reference in its entirety.

FIELD OF THE DISCLOSURE

This disclosure relates generally to process control, and, more particularly, to methods and apparatus to control combustion process systems.

BACKGROUND

Combustion processes, such as those used in process fired heaters, boilers, and the like, are used extensively throughout multiple industries for heating, vaporizing, or thermal cracking of various process fluids. Operation and maintenance of these combustion processes is challenging because incomplete or variable combustion can result in product variability, thermal stress on the equipment, environmental threats, and, if severe, unit explosions.

SUMMARY

Example methods and apparatus to control combustion process systems are disclosed. An example method includes monitoring an actual flow of fuel into a combustion process, calculating a relative heat release value corresponding to the fuel in the combustion process, and determining a fuel demand for the combustion process based on the relative heat release value.

An example apparatus includes a sensor to monitor an actual flow of fuel into a combustion process, a heat release calculator to calculate a relative heat release value corresponding to the fuel in the combustion process, and a cross-limiting calculator to determine a fuel demand for the combustion process based on the relative heat release value.

DETAILED DESCRIPTION

Figure 1:
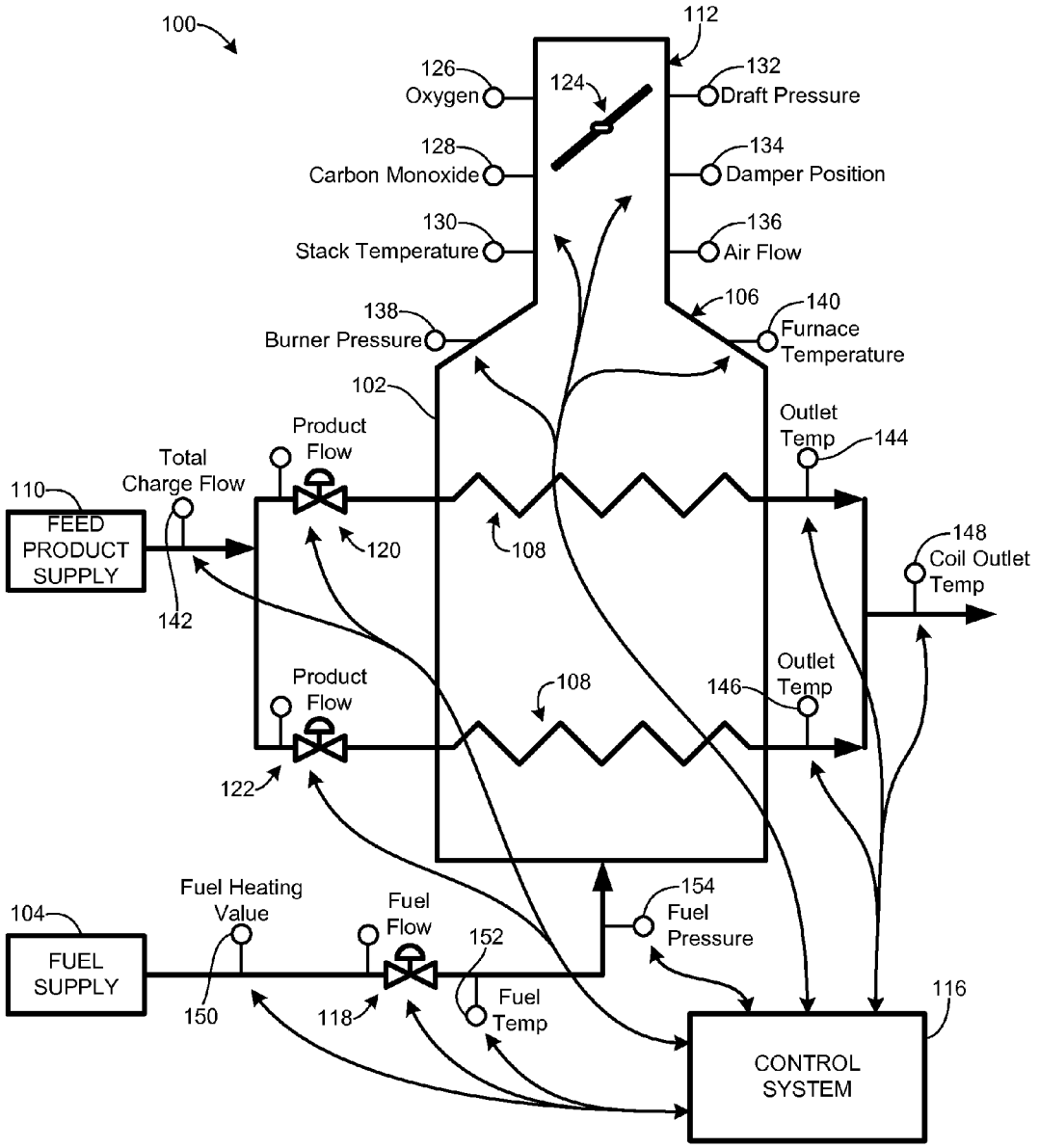
FIG. 1 illustrates an example combustion process system within which the teachings disclosed herein may be implemented.

The goal for a fired heater is to heat a process fluid to a desired temperature. Maintaining a constant outlet temperature is important to the process. Variations in outlet temperature introduce variability in the overall process. Although the optimum operation of a fired heater is typically near constraints (e.g., maximum tube temperatures, minimum excess air), variation in the process causes operators to stay away from the actual limit to provide a buffer or safety margin to handle any unexpected process upsets. As a result, manufacturers are not always able to maximize throughput or otherwise increase the efficiency of their assets.

Process fired heaters commonly utilize a waste fuel from the process that can have a widely varying heating value. Variations in fuel heating value introduce a challenge for controlling air and fuel demand. In many cases, the fuel and air relationship is operated with a substantial excess air safety buffer to reduce risks associated with incomplete combustion. This strategy of providing a significant safety buffer can result in inefficient operation and/or increased emissions. Significant variations in fuel heating value may also result in variations in final product quality, or sub-stoichiometric conditions.

Previous control solutions include standard proportional-integral-derivative (PID) control of product temperature and constraints with fixed mathematical algorithms to estimate the fuel energy changes needed to manage the fuel and air relationship. Typical combustion control solutions involve empirically derived air-to-fuel curves based on matching the mass of air with the mass of fuel to achieve a desired amount of excess air. However, these solutions are difficult to operate. Typically, the PID controls cannot properly manage multiple interactions of controlled, manipulated, and constraint variables. Empirical combustion curves must be set up by manually adjusting the airflow over all the possible fuel energy variations. This is often impossible to coordinate within an actively operating plant. Additionally, mass flow based calculations and/or curves cannot compensate for waste gas composition changes involving hydrogen, carbon dioxide, or inert gas.

Examples disclosed herein implement a strategy to simultaneously control combustion, throughput, and final product temperature of fired equipment to improve the safety and operation of these devices. The examples disclosed herein can be implemented in connection with any fired application (e.g., process fired heaters, thermal oxidizers, fired rotary dryers, lime kilns, reformers, cracking furnaces) that uses a waste fuel and/or fuel with a variable energy content (e.g., ethylene furnaces and/or steam methane reformers). The examples disclosed herein eliminate the fuel-to-air curves that have been used in automatic combustion control for the last sixty years by using an algorithm disclosed herein to coordinate the combustion air with the fuel for optimal and safe combustion. The examples disclosed herein determine air demand based upon fuel flow (either directly measured or inferred) and adjust the fuel flow target to compensate for varying heat content in the fuel.

The examples disclosed herein determine the air demand based upon the energy in the fuel (heat rate). The examples disclosed herein adjust the fuel heating value to compensate for the varying heat content in the fuel. The adjusted heating value is then used to determine the fuel flow target. This control strategy or technique provides consistent product temperature while minimizing excess air for improved efficiency and stable, consistent production, all within the configured constraints. Maintaining optimal excess air has the added benefit of reduced emissions.

The examples disclosed herein can be used in situations where, for example, the heating value is not directly measured, but a typical value is known. In some examples, the heating value of the fuel is inferred using specific gravity and/or chromatography. In such instances, the measured value is adjusted based upon the example algorithms disclosed herein, resulting in a further refinement to the combustion air demand.

According to the examples disclosed herein, the relationship between percent oxygen in the flue gas and percent excess combustion air is established from the fuel type. This strategy ensures the correct amount of air for combustion, even if the fuel varies in calorific value.

If a process fired heater is fired with purchased (e.g., "city") gas, the energy savings from improved efficiency provided by the examples disclosed herein can be significant. Even more significant savings can be realized by substituting available waste gas for relatively more expensive purchased gas. Waste gas in refineries and petrochemical plants typically fluctuates dramatically in composition, depending on which process unit is dumping to the fuel system. Large changes in hydrogen, nitrogen and hydrocarbon distribution are common for these waste streams. If the waste gas has a highly variable calorific value, it often cannot be used in critical units. However, examples disclosed herein provide a combustion strategy, as described in detail below, that compensates for a widely varying calorific value and, thus, enables fuel substitution that may lead to significant savings and/or increases in efficiency. Further, by enabling increased (e.g., maximum) capture of the available heat in the fuel with less variability, the combustion strategy provided by the examples disclosed herein reduces greenhouse gas emissions, makes the fuel available for other uses like boilers or co-gen plants, and enables more throughput in a capacity-constrained situation.

In addition to the coordination of fuel and air while compensating for varying energy content in the fuel, the examples disclosed herein use Model Predictive Control (MPC) to solve the complex task of stabilizing final product quality. That is, the examples disclosed herein combine enhanced combustion controls with MPC. The enhanced combustion controls disclosed herein ensure safe, stable combustion, and the MPC utilization of the examples disclosed herein provides optimal product control within process limits such as emissions, maximum firing inputs, equipment limitations, etc. In some examples, the utilization of MPC by the examples disclosed herein eliminates the use of multiple PID or PID equivalents for the same or better functionality.

Thus, the examples disclosed herein eliminate the need for the empirical air and fuel curves, provide methods and apparatus that compensate for varying energy content and/or combustion air demand of the fuel, improve unit safety, efficiency, and throughput of, for example, process fired heaters, while simultaneously reducing product variability and emissions. Further, the examples disclosed herein provide the capability of determining the relative energy variations of any fuel (e.g., solid, liquid or gaseous) on a real-time basis without sampling of the fuel stream. By defining the fuel energy content on a real-time basis, the total combustion air can be matched to the energy requirements, thereby reducing emissions and increasing safety of operations. By defining the energy content of any fuel, the examples disclosed herein normalize all fuels so the same combustion design and/or approach can be used on any device (e.g., a fired process heater). Matching the energy demand with the exact (e.g., within a negligible threshold) amount of energy in the combustion reduces variability and costs.

FIG. 1 is a diagram representative of an example combustion process system 100. The example combustion process system 100 is a process fired heater system that may be implemented to heat a process feed product flowing through tubes arranged inside the heater. Although a fired heater system is shown in FIG. 1, and the following explanation is given in the context of a fired heater, the teachings disclosed herein are applicable to any other combustion process such as, for example, a boiler, fired rotary dryer, etc. The example systems and methods are described herein as being advantageously applicable to controlling process heaters that use fuel with a variable heating value (e.g., because of a changing composition of the fuel over time). In particular, the example combustion process system 100 is described below as using a waste fuel that can include hydrogen (e.g., in some instances, hydrogen concentration can range from 25% to 75%, a mixture of light end hydrocarbons, incremental natural gas, or excess butane. However, in alternative implementations, the example systems and methods described herein may be used to control combustion production systems that use any type of fuel.

As shown in FIG. 1, the example system 100 includes a fired heater 102 that receives fuel gas from a fuel supply 104 that is mixed with air and combusted within a furnace 106 of the heater 102. In the illustrated example, tubes 108 carry a process feed or product fluid from a process feed product supply 110 through the furnace 106. The examples tubes 108 of the illustrated example are shown in a 2-pass arrangement. In other examples, the system 100 may be alternatively arranged with a single-pass fired heater 102. In other examples, the system 100 may be arranged with more than 2 passes (e.g., 4, 8, or 16). As the feed product passes through the fired heater 102, the heat generated by the burning fuel is transferred to the feed product. Any excess heat, exhaust, and/or emissions from the combustion process of the illustrated example are released via a stack or flue 112 on the top of the heater 102.

The example system 100 also includes an example control system 116 to acquire and monitor various operating conditions (e.g., fuel flow, airflow product flow, product temperature, etc.) of the example combustion system 100 to determine configuration settings (e.g., fuel flow and airflow) that may be used to operate the combustion system 100 within a predetermined, required and/or desired operating range (e.g., coil outlet temperature associated with the product), while maintaining other operating characteristics (e.g., fuel-to-air ratios, emissions, etc.) within predetermined, required or desired operating ranges. As described in greater detail below in connection with FIG. 2, the example control system 116 uses model predictive controls to predict configuration settings to substantially reduce or eliminate instances (or the time) during which the example system 100 operates in a non-compliant (and potentially inefficient and/or unsafe) condition. In particular, the control system 116 uses measurements of current and/or previous operating conditions to perform analyses to predict how the example system 100 may operate in the near or distant future and, based on those analyses, generates configuration settings for the product feed flow that are forward-looking to prevent the combustion system 100 from operating outside the predetermined, required or desired operating range(s). Additionally, the example control system 116 uses measurements that monitor the actual heat release of the combustion process to control the fuel firing rate for a consistent furnace temperature. In particular, the fuel flow and a corresponding heating value (based on the monitored heat release) of the fuel are monitored to determine a target airflow for the combustion process while the airflow and the heating value of the fuel are used to determine or adjust a target fuel flow or fuel demand. That is, the fuel flow and the airflow are analyzed via a cross-limiting strategy in connection with a corresponding heat release determined from the combustion of the associated fuel and air. In this manner, a controlled combustion environment is achieved to provide a more consistent product temperature than other known fired heaters while reducing (e.g., minimizing) excess air used in the system 100 for improved efficiency and stable consistent product. Furthermore, the example control system 116 monitors configured constraints to maintain the example system 100 within allowable limits to ensure safety of the system and quality of the product.

As shown in FIG. 1, the example control system 116 communicates with a fuel flow valve 118 to control the flow rate of fuel into the fired heater 102, product flow valves 120, 122 to control the flow rate or feed rate of the product through the fired heater 102 via the tubes 108, and a stack damper 124 to control the amount of air brought into heater 102 and, correspondingly, the amount of air and/or exhaust released from the heater 102. Additionally or alternatively, in some examples the example control system 116 communicates with a fan, blower, and/or associated damper to control the airflow through the heater 102. To measure the feed rates or flow rates of each of the supplies (e.g., fuel, feed product, airflow), the control system 116 of the illustrated example may be communicatively coupled to a plurality of sensors and/or other measurement devices.

In particular, an oxygen sensor 126 and a carbon monoxide sensor 128 are communicatively coupled to the example control system 116 to monitor the condition of the exhaust and emissions leaving the heater 102 via the stack 112. Specifically, oxygen and carbon monoxide indicate the state of combustion in the heater 102 in substantially real time. By monitoring the combustion process in this manner, in some examples, the control system 116 determines adjustments to be made to the process to stabilize the unit, improve efficiency, and/or reduce emissions. In some examples, other sensors are included in addition to the oxygen sensor 126 and the carbon monoxide sensor 128 to monitor other emissions (e.g., nitrogen oxides, sulfur dioxide, particulates, carbon dioxide, etc.) on a real-time basis to comply with environmental regulations and/or add constraints to the operation of the process system.

In some examples, a draft pressure sensor 132 is communicatively coupled to the example control system 116 to be used to detect flame stability in the heater 102. In many instances, one challenge in operating a fired heater is instability of the burner flames, which is especially relevant when there are large and/or fast changes in the heating value or energy content of the fuel (e.g., due to refinery upsets for which the combustion controls cannot adequately compensate). When a flame is unstable, it may flicker or flame-out, which is a dangerous condition that may result in leaving unburned fuel in the furnace. Some known techniques may be used to avoid such conditions. However, these techniques are often subject to false alarms, may only detect conditions after the flame is out, and/or may be cost prohibitive to maintain and/or install. Accordingly, in some examples, flame stability is monitored and detected based on the draft pressure measured via the draft pressure sensor 132. In such examples, the detection of flame stability is based on the premise that dynamic processes have a unique noise or variation signal under normal conditions such that changes to these characteristic signatures are indicative of a change in the process. As such, in some examples, the draft pressure is monitored to identify changes inconsistent with the combustion process operating under a stable flame to alert and/or adjust the system before the flame out and a shutdown of the furnace.

In some examples, a stack temperature sensor 130, a damper position sensor 134, and an airflow sensor 136 are communicatively coupled to the example control system 116 to monitor the condition of the airflow leaving the heater 102 via the stack 112. Specifically, in some examples, such measurements are used to maintain safe and stable firing and to improve (e.g., optimize) the combustion process in real time for more consistent product temperature, greater efficiency, and/or reduced emissions. In some examples, how the airflow measurement is obtained depends on the type of furnace involved and the particular site equipment. For instance, fired heaters can typically be classified as any of a forced draft heater, a balanced draft heater, or a natural draft heater. In forced draft or balanced draft heater processes, airflow can be controlled by modulating the speed of a forced draft fan with, for example, a variable speed drive to allow precise and repeatable control of airflow over a wide range at a reduced cost due to reduced electric use. Alternatively, or in some examples, in addition to modulating fan speed, an associated damper can be modulated to control airflow. To measure airflow in such examples, a sensor can be placed either at the inlet of a forced draft fan or in an air duct between the forced draft fan and the heater 102. In some examples, the sensor uses Averaging Pitot Tube (APT) technology to overcome challenges resulting from duct shape, lack of straight runs, lack of external clearance, flow stratification in the duct, etc. In natural draft processes (such as the example process system 100 illustrated in FIG. 1), airflow is adjusted by modulating the damper 124 within the stack 112. Typically, airflow is not directly measured in natural draft heaters as such measurements are challenging because there is no fan or duct within which to locate a sensor. However, in the illustrated example, the airflow sensor 136 is placed within the stack 112 includes the APT technology described above to monitor flue gas flow as it changes based on the position of the stack damper 124. Flue gas flow can be used to infer airflow. In some examples, the damper 124 is actuated with a digital controller with online calibration, configuration, and diagnostic functionality to enable accurate positioning of the damper 124 as well as ensuring the reliability and repeatability of damper movement over time.

In the illustrated example of FIG. 1, a burner pressure sensor 138 and a furnace temperature sensor 140 are communicatively coupled to the control system 116 to monitor the conditions inside the furnace 106 of the heater 102. Such measurements are used in some examples as constraints on the control process disclosed herein to ensure a safe and stable process environment.

Additionally, in some examples, a total charge flow sensor 142, product outlet temperature sensors 144, 146, and a coil outlet temperature sensor 148 are communicatively coupled to the control system 116 to monitor the conditions of the feed product passing into and out of the heater 102. In some examples, the total charge flow corresponds to the total flow of feed product passing through the heater 102 via all passes. In some examples, the coil outlet temperature corresponds to the combined temperature of the feed product in each pass as it leaves the heater 102 (e.g., obtained from each product outlet temperature sensor 144, 145). Often, a process objective is to control the process to achieve a target coil outlet temperature of the material leaving the furnace. Accordingly, the coil outlet temperature and the total charge flow in some examples are used as the primary or master inputs or setpoints used to define the required heat release from the combustion process in the heater 102. In particular, there is often a balance to be struck between increasing the heater outlet temperature (e.g., up to the coking limit) to improve yields and lowering the temperature to extend the running time of the combustion process (e.g., before the heater needs to be decoked). Accordingly, in some examples, the control system 116 uses the above parameters in connection with MPC to keep the outlet temperature of each product pass substantially equal (e.g., pass balancing), thereby reducing the likelihood of one set of tubes 108 in the heater 102 from coking faster than the others to increase (e.g., maximize) operation running length while improving (e.g., maximizing) the quality of the process yield with reduced variability. Maintaining relatively constant temperature across all furnace tubes also reduces the likelihood for hot spots on tubes which get overheated. Furthermore, such control techniques also increase (e.g., maximize) the total feed or throughput processed by the system without exceeding heater constraints and/or other limits.

Further still, a fuel heating value sensor 150, a fuel temperature sensor 152, and a fuel pressure sensor 154 are communicatively coupled to the control system 116 to monitor the conditions of the fuel being fed into the heater 102, which is one of the primary parameters used in the combustion control system described herein. Specifically, disclosed examples calculate a heat release within the combustion process to infer a BTU (energy) content or heating value of the fuel which, when combined with the flow rate of the fuel can be used in the combustion process system 100 to calculate and control airflow into the system to maintain a stable, safe, and efficient combustion process. In some examples, the temperature and pressure sensors 152, 154 are used to calculate a mass flow of the fuel. Additionally or alternatively, in some examples, a coriolis flow meter may be used to measure mass flow, which can be correlated to the mass-based heating value of the fuel. Furthermore, in some examples, other types of flow measurement devices are implemented. For example, orifice plates with differential pressure transmitters or vortex meters may be used to monitor the flow of the fuel. In some examples, a gas specific gravity meter may be installed to infer a value of the BTU content of the fuel on a real-time or substantially real-time basis.

Although not shown, other additional sensors (e.g., temperature sensors, flow/feed sensors, pressure sensors, etc.) located throughout the example combustion process system 100 can be communicatively coupled to the control system 116 to obtain measured values for use in implementing the example systems and methods described herein. Furthermore, the particular locations of any of the sensors described herein and/or the parameters monitored by the sensors may be adapted based on the needs of the particular application in which the teachings of this disclosure are implemented.

Figure 2:
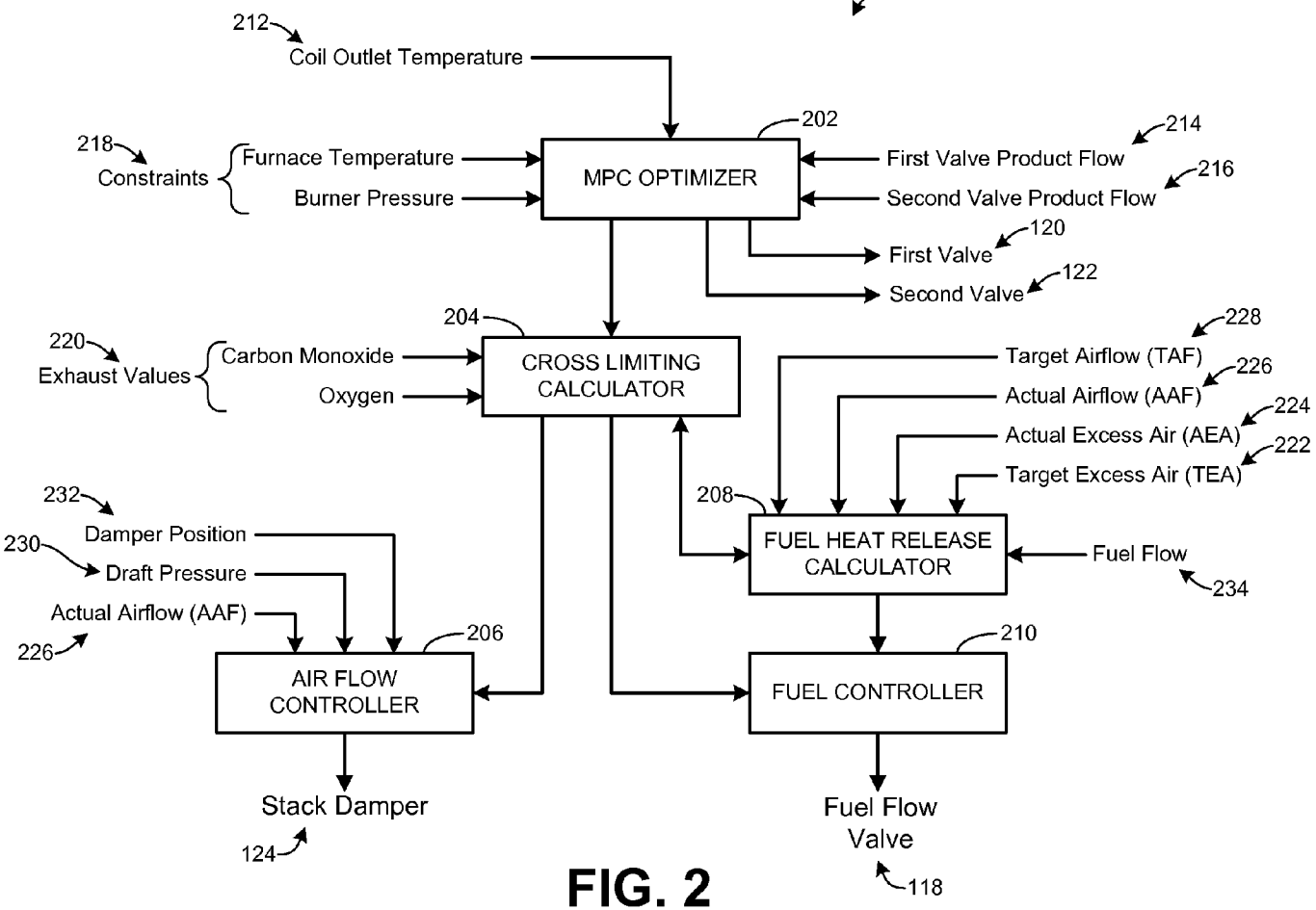
FIG. 2 is block diagram of the example control system of FIG. 1 constructed in accordance with the teachings disclosed herein.

FIG. 2 is a detailed block diagram of the example control system 116 of FIG. 1. The control system 116 may use predictive control techniques to control operation of the example combustion system 100 by determining forward-looking or predicted configuration settings based on present-time monitored conditions. In this manner, the control system 116 can respond proactively to the monitored conditions by changing or adjusting configuration settings to substantially reduce or prevent the example system 100 from operating out of predetermined, desired or required operating conditions (e.g., a coil outlet temperature associated with the product feed).

In the illustrated example, the control system 116 includes a model predictive control (MPC) optimizer 202, a cross-limiting calculator 204, an airflow controller 206, a fuel heat release calculator 208, and a fuel controller 210. In an example implementation, the MPC optimizer 202 may be implemented using a MPC available in the DeltaV control system designed and sold by Emerson Process Management of Austin, Tex. The MPC optimizer 202 is configured to control a flow rate of product feed passing through the fired heater 102 in response to a coil outlet temperature 212, and product flow rates 214, 216 corresponding to each product flow valve (e.g., the product flow valves 120, 122 of FIG. 1). More particularly, in some examples where the combustion process system 100 includes a multi-pass heater (e.g., the heater 102 in FIG. 1 that is shown as a 2-pass heater), the MPC optimizer 202 is configured to balance the outlet temperature of the product for each pass while keeping the overall coil outlet temperature at a desired setpoint. That is, the MPC optimizer 202, of the illustrated example, provides a control signal to each product flow valve 120,122 to control the product flow through each pass to maintain a substantially consistent outlet temperature within each pass as well as a consistent coil outlet temperature.

In addition to controlling the flow of product through each pass of the heater 102, in some examples, the MPC optimizer 202 of the illustrated example also uses the coil outlet temperature 212 and a total charge flow (e.g., the total product flow through all passes in the heater) to regulate the fuel firing rate to the furnace 106 of the heater 102. In some examples, the MPC optimizer 202 uses the coil outlet temperature and total charge flow to provide an initial or master setpoint for fuel demand to be provided to the combustion and fuel systems (e.g., the airflow controller 206 and the fuel controller 210) based on a cross-limiting strategy described more fully below. In some examples, to account for fluctuations in the total charge flow (e.g., due to changes from the multi-pass balancing control of the MPC optimizer 202) a feed forward strategy, based on a total charge flow, is implemented. In other examples, the MPC optimizer 202 generates the initial fuel demand parameter in connection with the pass balancing of the feed product flowing through the tubes 108 of the heater 102. In such examples, the initial fuel demand generated directly through the MPC calculations may bypass calculation of the fuel demand based on the coil outlet temperature and total charge flow.

To prevent operating the process in unstable, unsafe, and/or otherwise undesirable conditions, the example MPC optimizer 202 is also provided with a plurality of constraint values 218 (e.g., burner pressure, furnace temperature, etc.) that limit the heater demand. In some examples, the MPC optimizer 202 calculates separate fuel demands for the combustion process based on a high burner pressure and a low burner pressure (measured via the burner pressure sensor 138) relative to user specified burner pressure setpoints. Additionally, the example MPC optimizer 202 calculates a fuel demand based on the furnace temperature (measured via the furnace temperature sensor 140) relative to a user specified furnace temperature setpoint. In some examples, the burner pressure has a range of 0 to 15 pounds per square inch gauge (psig) and the furnace temperature has a range of 50° F. to 1600° F. To determine a constrained fuel demand, in some examples, the MPC optimizer 202 uses the initial required fuel demand (e.g., based on the coil outlet temperature) to predict whether that demand will violate the low and high burner pressure constraints. In some examples, the MPC optimizer 202 will adjust the initial required fuel demand to a pressure constrained fuel demand so that the burner pressure constraints are not violated. In some such examples, the MPC optimizer 202 will further compare the pressure constrained fuel demand to the furnace temperature constraint and predict if violation will occur and adjust accordingly to a final constrained fuel demand that is used as an input into the cross-limiting calculator 204.

In the illustrated example, the control system 116 is provided with the cross-limiting calculator 204 to implement a cross-limiting strategy, as described more fully below, that controls both airflow and fuel flow based on monitored values of the airflow and fuel flow. Additionally, in the illustrated example of FIG. 2, the cross-limiting calculator 204 is provided with a plurality of exhaust gas values 220 indicative of the presence of oxygen (e.g., as measured by the oxygen sensor 126) and carbon monoxide (e.g., as measured via the carbon monoxide sensor 128) in the flue or stack 112 of the heater 102 of FIG. 1, which are also used as inputs into the in the cross-limiting calculations described below. In some examples, the oxygen in the stack 112 ranges from 0% to 10% (e.g., by volume) of the exhaust leaving the heater 102 and the carbon monoxide in the stack ranges from 0 to 100 parts per million (ppm). In the illustrated example, the measured amount of oxygen is used to trim the combustion air within the heater 102 to maintain a desired amount of excess air to achieve a safe environment while improving (e.g., maximizing) efficiency. In some examples, the cross-limiting calculator 204 includes the functionality of an oxygen trim controller configured to calculate an oxygen trim factor based on the measured oxygen relative to a user specified base oxygen setpoint. Additionally, in some examples, the cross-limiting calculator 204 is configured to operate in a Cascade mode with a cascade setpoint provided via a bias/gain station. In some examples, when the bias/gain station is set to Auto, a user has the ability to bias the base oxygen setpoint up or down by 2%. When the bias/gain station is set to Cascade, the oxygen bias is calculated based on the amount of carbon monoxide measured in the stack 112. For example, if the combustibles (e.g., carbon monoxide) level increases, the oxygen setpoint bias increases to decrease carbon monoxide emissions. In some such examples, the bias to the base oxygen setpoint ranges from 0% to 5%. In the illustrated example, the bias value, either user specified (Auto) or calculated from the carbon monoxide measurement (Cascade), is summed with the user specified base oxygen setpoint for a final oxygen setpoint used to determine the oxygen trim factor.

Figure 3:
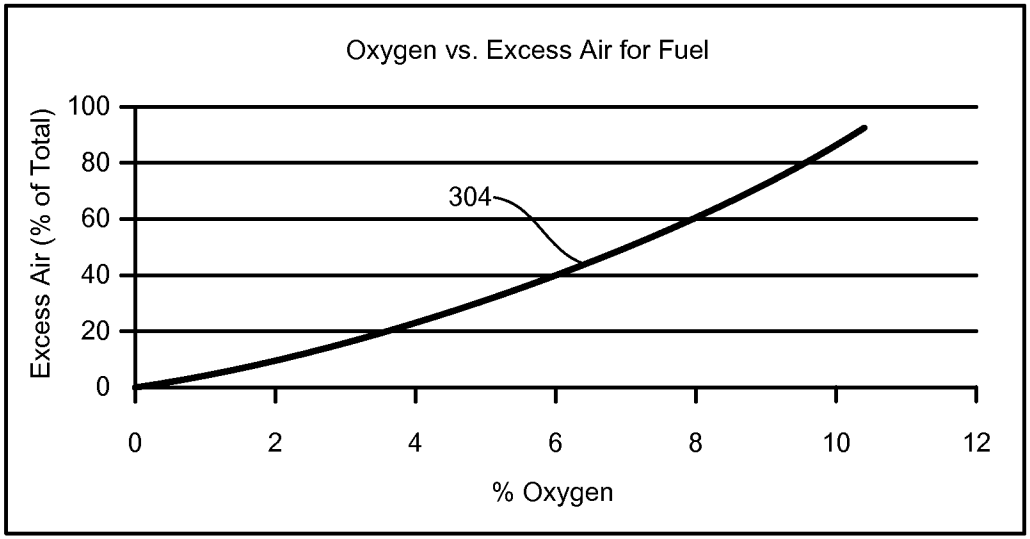
FIG. 3 illustrates an example table and corresponding graph indicative of a relationship of percent oxygen to excess air for an example fuel used in the combustion process system of FIG. 1

In some examples, the cross-limiting calculator 204 controls airflow to the heater 102 (via the airflow controller 206 as described more fully below) by trimming the target airflow with the calculated oxygen trim factor. In some examples, the oxygen trim factor ranges from 80% to 120%, which corresponds to a plus or minus 20% trim of the total air range. Additionally, in some examples, the cross-limiting calculator 204 uses the actual oxygen in the stack 112 to determine the actual excess air (AEA) 224, which is used to calculate the heat release of the fuel to further control the combustion process (via the fuel heat release calculator 208 as described more fully below). Similarly, cross-limiting calculator 204 uses the oxygen setpoint to determine a target excess air (TEA) 222 (e.g., the total amount of excess air desired in the combustion process), which is also provided to the fuel heat release calculator 208. The AEA and the TEA are determined based on the relationship of a known oxygen level (e.g., the oxygen setpoint and/or the actual oxygen measured) and excess air. In particular, for any given fuel composition, there is a corresponding relationship between excess air and oxygen level resulting from a combustion process involving the fuel. For instance, FIG. 3 illustrates an example table 300 and a corresponding graph 302 with a curve 304 representative of the relationship of oxygen to excess air. In the illustrated example of FIG. 3, oxygen is expressed as a percentage (e.g., by volume) of the flue gas leaving the combustion system and the excess air is expressed as a percentage (e.g., by volume) of the total air that entered the combustion process. Similar curves can be generated for any fuel composition. Accordingly, in the illustrated example, a characteristic fuel composition may be assumed and the resulting curve used to calculate the TEA and the AEA. More particularly, the TEA corresponds to the value of the excess air on the curve associated with the oxygen setpoint. Similarly, the AEA corresponds to the value of the excess air on the curve associated with the oxygen measured in the stack 112 of the heater 102.

Returning to FIG. 2, as described above, in some examples, the composition of fuel provided in the combustion process can vary over time. As a result, the heating value or energy content of the fuel also changes over time. To account for such changes, the example control system 116 includes the fuel heat release calculator 208 to calculate a BTU (British thermal unit) trim factor to trim the fuel demand. The use of BTUs as a specific metric or unit of energy is provided for the sake of clarity in explaining the teachings disclosed herein. Accordingly, where specific example values and their corresponding units are provided for particular parameters used in connection with the systems and methods disclosed herein, such values and corresponding units can be converted to any other set of metrics or units based on the appropriate conversion factor(s). It is generally known that, for a given BTU content, the fuel in a combustion process consumes a stoichiometric amount of air. Further, if the heating value (e.g., BTU content) of the fuel changes, the amount of stoichiometric air consumed during combustion also changes. Accordingly, in some examples, the fuel heat release calculator 208 determines a relative heat release value corresponding to the ratio of an actual (e.g., measured) stoichiometric air demand (ASAD) in a combustion process to a predicted (e.g., targeted or expected) stoichiometric air demand (PSAD). The relative heat release value can be expressed as follows:

$$\text{Relative heat release} = \text{ASAD}/\text{PSAD} \qquad \text{Equation 1.}$$

The ratio of equation 1 provides an indication of the relative difference between the predicted stoichiometric air demand (e.g., predicted based on a given air-to-fuel ratio) and the actual stoichiometric air demand (e.g., based on variability in the heat content of the fuel). In some examples, the actual stoichiometric air demand (ASAD) may not be known but it is related to an actual airflow (AAF) 226 (measured by the airflow sensor 136 of FIG. 1) into the combustion process and the actual excess air (AEA) 224 (determined based on the oxygen measured by the oxygen sensor 126 as described above) leaving the combustion process. In some examples, the actual excess air corresponds to an excess air factor between 1 and 2. The relationship between ASAD, AAF, and AEA can be expressed as follows:

$$\text{AAF} = \text{ASAD} \times \text{AEA} \qquad \text{Equation 2.}$$

Thus, although the actual stoichiometric air demand may be unknown, it can be solved for by rewriting equation 2 as follows:

$$\text{ASAD} = \text{AAF}/\text{AEA} \qquad \text{Equation 3.}$$

Similarly, while the predicted stoichiometric air demand may not be known, it is related to desired or target airflow (TAF) 228 (determined via the cross-limiting calculator 204 as described more fully below) into the combustion process and the target excess air (TEA) 222 (determined based on the oxygen setpoint as described above). In some examples, the target excess air corresponds to an excess air factor between 1 and 2. The relationship between PSAD, TAF, and AEA can be expressed as follows:

$$TAF=PSAD\times TEA \quad \text{Equation 4.}$$

Accordingly, although the predicted stoichiometric air demand may be unknown, it can be solved for by rewriting equation 4 as follows:

$$PSAD=TAF/TEA \quad \text{Equation 5.}$$

Inserting equations 3 and 5 into equation 1 provides:

$$\text{Relative heat release}=(AAF/AEA)/(TAF/TEA) \quad \text{Equation 6.}$$

Equation 6 can then be rewritten as the ratio of actual airflow to target airflow multiplied by the ratio of target excess air to actual excess air as follows:

$$\text{Relative heat release}=(AAF/TAF)\times(TEA/AEA) \quad \text{Equation 7.}$$

Based on the relative heat release value calculated using Equation 7, the fuel heat release calculator 208 can determine the amount of change in a heating value (e.g., BTU content) of the fuel without regard to changes in airflow. In some examples, a baseline or initial heating value for the fuel may be assumed (e.g., based on an assumed composition of the fuel) and the relative heat release value can be used to determine a BTU trim factor to adjust or trim the assumed heating value of the fuel to compensate for variations in the composition of the fuel as it is being burned in the combustion system. In some examples, the initial heating value is measured (e.g., via the fuel heating value sensor 150 shown in FIG. 1). In some examples, the relative BTU value ranges from 0 to 2 with a setpoint of 1. For example, when the actual heating value of fuel is equal to the predicted heating value of the fuel, the relative BTU value is 1. However, if the heating value of the fuel changes by increasing, for example, by 10%, the stoichiometric amount of air consumed will similarly increase by 10%, yielding a relative BTU value of 1.1. In the illustrated example, the fuel heat release calculator 208 also functions as a BTU compensation controller to adjust (trim) the fuel heating value in order to bring the relative BTU value to the setpoint of 1. In this example, the fuel heat release calculator 208 will determine a BTU trim factor to increase the initial heating value by 10%. The trimmed heating value, in such an example, is then used to control the fuel flow so that the correct amount of fuel (based on its energy content) will be provided into the combustion process. In contrast, if the heating value of the fuel is not trimmed, the heat released by the fuel will not be correctly known and the resulting fuel flow will not be controlled as desired causing upsets in the process. In particular, in some examples, the resulting trimmed fuel heating value is multiplied by the flow rate of the fuel (e.g., as measured via the fuel pressure and temperature sensors 152, 154, and/or some other flow sensor) to calculate a trimmed fuel flow that is provided to the cross-limiting calculator 204 to perform the air-to-fuel cross-limiting calculations.

In the illustrated example, the control system 116 is provided with the cross-limiting calculator 204 to implement a cross-limiting strategy to ensure that air leads fuel on increasing fuel demand and lags fuel on decreasing fuel demand. In the illustrated examples, the cross-limited fuel demand is calculated based on the constrained fuel demand (as determined by the MPC optimizer 202 described above) and the fuel demand based on actual air available for combustion. The cross-limited air demand is calculated based on the desired percent oxygen in the stack 112 (e.g., the oxygen setpoint determined by the cross-limiting calculator 204) and the greater of the constrained fuel demand (as determined by the MPC optimizer 202 described above) and the trimmed heating value of the fuel (as calculated by the fuel heat release calculator 208 described above).

In particular, the cross-limited air demand in the illustrated example can be expressed as:

$$XAD=FDmax\times AFR\times TEA \quad \text{Equation 8.}$$

where XAD is the cross-limited air demand, FDmax is the maximum fuel demand calculated for the combustion system (e.g., as between the constrained fuel demand and the trimmed heating value of the fuel), AFR is the air-to-fuel ratio, and TEA is the target excess air. The cross-limited air demand (XAD) corresponds to the target airflow (TAF) that is provided to the fuel heat release calculator 208 to determine the BTU trim factor as described above. Further, as described above, the BTU trim factor is used to calculate the trimmed heating value, which is used in determining FDmax. Accordingly, the XAD (or TAF) loops on itself through the implementation of the teachings disclosed herein, thereby enabling a constant update of the target airflow to continually adjust the system to meet changing circumstances (e.g., variation in the fuel composition). In some examples, the constrained fuel demand is a scaled value expressed relative to a maximum heater load. Accordingly, in comparing the constrained fuel demand to the trimmed heating value, in some examples, the cross-limiting calculator 204 first converts the constrained fuel demand parameter to units of million metric BTUs per hour (MMBtu/hr) using a scaler corresponding to 100% of the heater load (expressed in MMBtu/hr). For example, if the maximum load of a heater is 75 MMBtu/hr, that value is used to convert the constrained fuel demand into units corresponding to the trimmed heating value of the fuel. The air-to-fuel ratio (AFR) used in Equation 8 above is an adjustable value set by a user. Typically, the AFR is set to approximately to 0.70 thousand pounds of air to million BTUs of fuel (Mlb Air/MMBtu Fuel). The target excess air (TEA) corresponds to the target excess air provided to the fuel heat release calculator 208 as described above.

As described above, the cross-limited fuel demand is based on the lesser of the constrained fuel demand and the fuel demand based on actual air available for combustion. The fuel demand based on actual air available (FDA) can be expressed as:

$$FDA=DB\times(AAF/OTS)/(AFR\times TEA) \quad \text{Equation 9.}$$

where DB is the deadband, AAF is the actual airflow into the heater, OTS is the oxygen trim signal, AFR is the air-to-fuel ratio, and TEA is the target excess air. The actual airflow (AAF) corresponds to the actual airflow that is measured by the airflow sensor 136 and provided to the fuel heat release calculator 208 to determine the relative heat release value and BTU trim factor as described above. The oxygen trim signal (OTS) corresponds to the oxygen trim factor described above except that the OTS is expressed on a scale of 0.8 to 1.2 rather than on a scale from 80% to 120% (i.e., OTS is equivalent to the oxygen trim factor divided by 100). The air-to-fuel ratio (AFR) and the target excess air (TEA) are the same as described above with respect to Equation 8.

The resulting fuel demand based on actual air available (FDA) of Equation 9 is in units of MMBtu/hr (e.g., FDA is an expression of the heat rate of fuel in the combustion system based on the actual air available). Accordingly, to compare the FDA to the constrained fuel demand, in some examples, the cross-limiting calculator 204 converts the constrained fuel demand parameter to the corresponding units using the scaler as described above. In some such examples, the cross-limited fuel demand is identified as the lower of the two values. In some examples, the cross-limited fuel demand is converted back into a flow rate (e.g., thousand standard cubic feet per hour (MSCPH)) and provided as a cascade setpoint or target fuel flow to the fuel controller 210. In some examples, the trimmed heating value for the fuel is used as the conversion factor.

In the illustrated example, the fuel controller 210 monitors a fuel flow 234 and actuates and/or controls a corresponding fuel flow valve 118 to adjust the flow of fuel based on a monitored fuel flow 234 relative to the cross-limited fuel demand. In this manner, a controlled heat rate of the fuel is possible even when the BTU content of the fuel varies over time. In some examples, the setpoint for the fuel controller can be user specified to run independent of the rest of the control system 116. In some examples, the fuel flow valve 118 is configured to fail to a closed position such that fuel flow stopped if there is a loss of communication with the control system 116 and/or any other issue. Additionally, in some examples, the fuel controller 210 has the capability for interlocks that open (or close) the valve 118. In such examples, the interlocks can be bypassed (with the appropriate account privileges of the user) for testing.

Further, in the illustrated example, the control system 116 is provided with the airflow controller 206 to control the flow of air into and/or out of the combustion process system 100. As described above, the cross-limiting calculator 204 determines the cross-limited air demand (XAD), which corresponds to the target airflow (TAF) used by the heat release calculator 208. In some examples, the cross-limited air demand (XAD) or target airflow (TAF) is also provided to the airflow controller 206 where the value is multiplied by the oxygen trim factor to become a trimmed target airflow used as an initial cascade setpoint for the airflow controller 206. In some examples, the airflow controller 204 also includes the functionality of a draft pressure controller that monitors a draft pressure 230, which may be used as an override controller for the stack damper 124. That is, in some examples, the airflow controller 206 calculates a first demand for the damper 124 based on the AAF 226 and a second demand for the damper 124 based on the draft pressure 230. In such examples, the airflow controller 206 selects the higher value between the first and second demands as the final setpoint used to control a position 232 of the damper 124. In some such examples, the selected setpoint for the damper 124 characterized to counter the non-linearities of the process response to changes in the damper position. In some examples, the stack damper 124 is configured to fail to an open state if there is a loss of an instrument signal from the control system 116. Additionally, in some examples, the airflow controller 206 has the capability for interlocks that open (or close) the damper 124. In such examples, the interlocks can be bypassed (e.g., with the appropriate account privileges of the user) for testing.

While an example manner of implementing the example control system 116 of FIG. 1 is illustrated in FIG. 2, one or more of the elements, processes and/or devices illustrated in FIG. 2 may be combined, divided, re-arranged, omitted, eliminated and/or implemented in any other way. Further, the example MPC Optimizer 202, the example cross-limiting calculator 204, the example airflow controller 206, the example fuel heat release calculator 208, the example fuel controller 210, and/or, more generally, the example control system 116 of FIG. 2 may be implemented by hardware, software, firmware and/or any combination of hardware, software and/or firmware. Thus, for example, any of the example MPC Optimizer 202, the example cross-limiting calculator 204, the example airflow controller 206, the example fuel heat release calculator 208, the example fuel controller 210, and/or, more generally, the example control system 116 of FIG. 2 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example MPC Optimizer 202, the example cross-limiting calculator 204, the example airflow controller 206, the example fuel heat release calculator 208, and/or the example fuel controller 210 is/are hereby expressly defined to include a tangible computer readable storage device or storage disk such as a memory, a digital versatile disk (DVD), a compact disk (CD), a Blu-ray disk, etc. storing the software and/or firmware. Further still, the example control system 116 of FIG. 1 may include one or more elements, processes and/or devices in addition to, or instead of, those illustrated in FIG. 2, and/or may include more than one of any or all of the illustrated elements, processes and devices.

Flowcharts representative of example methods for implementing the example control system 116 of FIG. 2 are shown in FIGS. 4-11. In this example, the methods may be implemented using machine readable instructions that comprise a program for execution by a processor such as the processor 1212 shown in the example processor platform 1200 discussed below in connection with FIG. 12. The program may be embodied in software stored on a tangible computer readable storage medium such as a CD-ROM, a floppy disk, a hard drive, a digital versatile disk (DVD), a Blu-ray disk, or a memory associated with the processor 1212, but the entire program and/or parts thereof could alternatively be executed by a device other than the processor 1212 and/or embodied in firmware or dedicated hardware. Further, although the example program is described with reference to the flowcharts illustrated in FIGS. 4-11, many other methods of implementing the example control system 116 may alternatively be used. For example, the order of execution of the blocks may be changed, and/or some of the blocks described may be changed, eliminated, or combined.

As mentioned above, the example methods of FIGS. 4-11 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals. As used herein, "tangible computer readable storage medium" and "tangible machine readable storage medium" are used interchangeably. Additionally or alternatively, the example methods of FIGS. 4-11 may be implemented using coded instructions (e.g., computer and/or machine readable instructions)

stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable device or disk and to exclude propagating signals. As used herein, when the phrase "at least" is used as the transition term in a preamble of a claim, it is open-ended in the same manner as the term "comprising" is open ended.

The example method of FIG. 4 begins at block 400 where the example MPC optimizer 202 controls a flow of product through a fired heater, which is described in detail below in connection with the flowchart of FIG. 5. As described above, although the following figures are described in the context of a fired heater, the example methods described herein may be implemented with respect to any sort of combustion process. At block 402, the example MPC optimizer 202 determines a constrained fuel demand, which is described in detail below in connection with the flowchart of FIG. 6. At block 404, the example cross-limiting calculator 204 monitors exhaust from the heater to determine oxygen trim, actual excess air, and target excess air, which is described in detail below in connection with the flowchart of FIG. 7. At block 406, the example fuel heat release calculator 208 determines a BTU trim factor, which is described in detail below in connection with the flowchart of FIG. 8. At block 408, the example fuel heat release calculator 208 determines the trimmed heat rate and trimmed heating value of the fuel, which is described in detail below in connection with the flowchart of FIG. 9.

At block 410, the example cross-limiting calculator 204 calculates a cross-limited air demand. As described above, the cross-limited air demand is calculated based on the desired percent oxygen in the stack 112 and the greater of the constrained fuel demand and the trimmed heating value of the fuel in accordance with Equation 8 described above. In the example method of FIG. 4, the desired percent oxygen corresponds to the oxygen setpoint which is used to calculate the target excess air (TEA) used in Equation 8. Determining the oxygen setpoint and corresponding TEA are described in greater detail below in connection with FIG. 7, which corresponds to block 404 of the example method of FIG. 4. The constrained fuel demand is determined at block 402, which is described in greater detail below in connection with FIG. 6. The trimmed heating value of the fuel is determined at block 408, which is described in greater detail below in connection with FIG. 9.

At block 412, the example cross-limiting calculator 204 calculates a cross-limited fuel demand. The cross-limited fuel demand is calculated based on the lesser of the constrained fuel demand (e.g., determined at block 402) and the fuel demand based on actual air available for combustion. As described above, the fuel demand based on actual air available (FDA) is calculated based on Equation 9 and takes into account the actual airflow (AAF), the oxygen trim signal (corresponding to the oxygen setpoint), and the TEA as well as several user specified parameters (e.g., the deadband and the air-to-fuel ratio). In the example method of FIG. 4, the AAF is determined at block 406, as described more fully below in connection with FIG. 8. The oxygen setpoint and TEA are the same as described above in connection with block 410.

At block 414, the example fuel flow controller 210 controls a fuel flow into the heater, which is described in detail below in connection with the flowchart of FIG. 10. At block 416, the example airflow controller 206 control airflow into the heater, which is described in detail below in connection with the flowchart of FIG. 11. At block 418, the example control system 116 determines whether to end the control process. For example, if a user or some other control system (e.g., a safety control system) provides the control system 116 with a stop request, the control system 116, in response to the stop request, ends the control process and/or returns control to a calling process or function such as, for example, a shutdown process, an idle process, etc. Otherwise, if the control system 116 determines that it should not end the control process, control is passed back to block 400.

Figure 4:
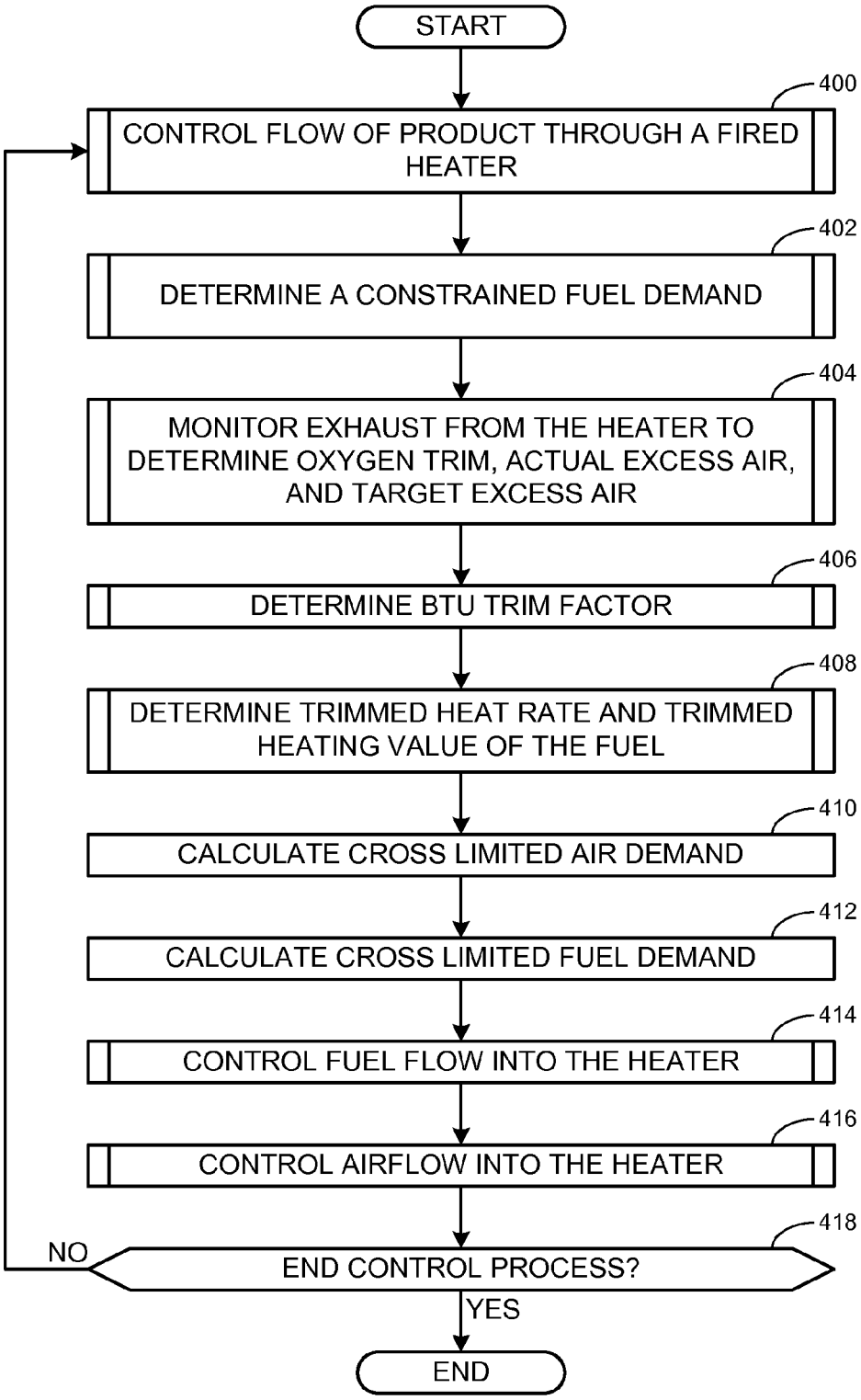
FIGS. 4-11 are flowcharts representative of example processes for implementing the example control system of FIGS. 1 and/or 2.
Figure 5:
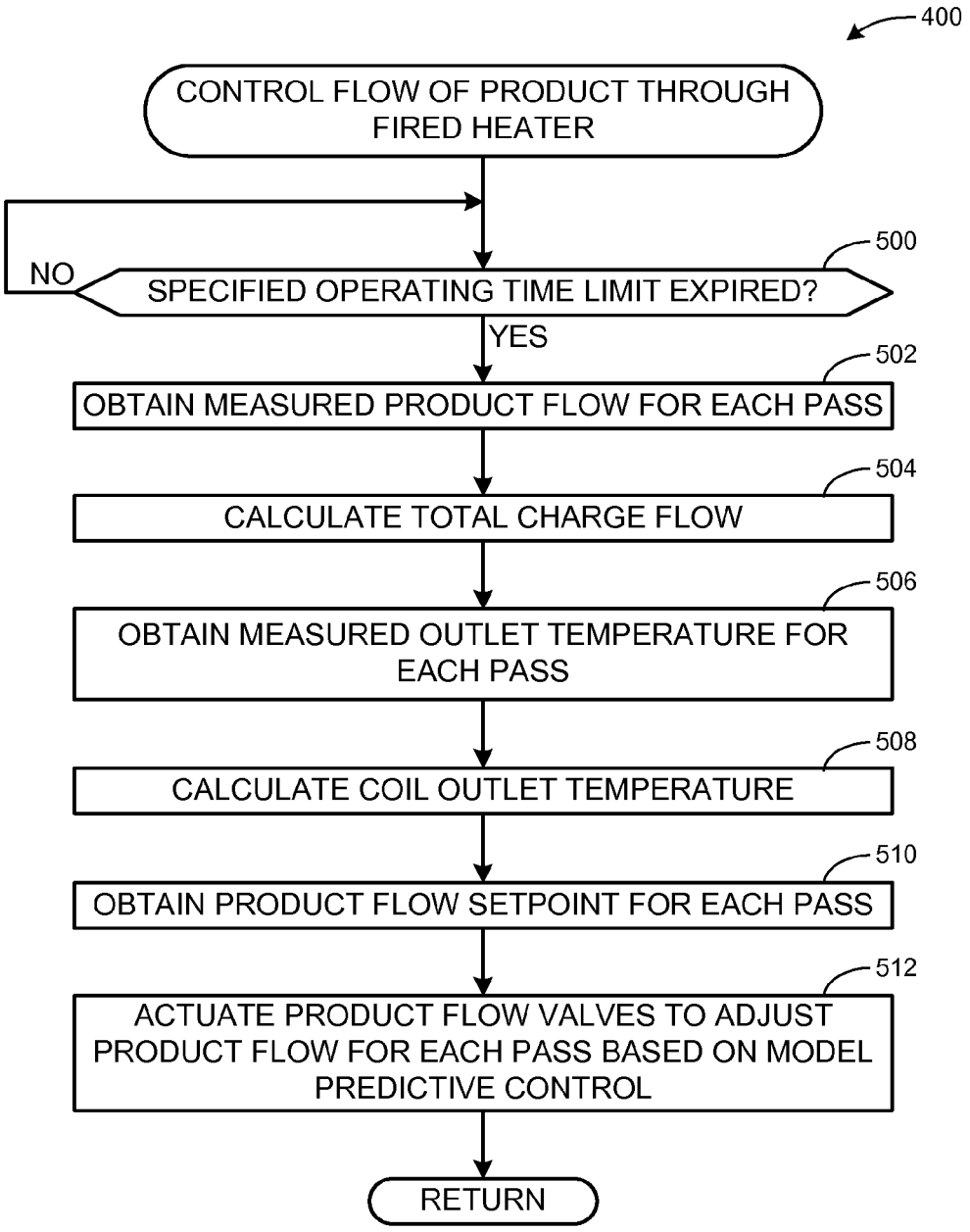

FIG. 5 is a flowchart representative of an example method that may be used to implement the operation of block 400 of FIG. 4 to control the flow of product through a fired heater. The example method of FIG. 5 begins at block 500 where the example MPC controller determines whether a specified operating time limit has expired. The specified operating time limit is specified by the example MPC optimizer 202 after each time it generates a predicted trajectory adjustment output value to control the flow of product feed through the heater and is associated with the amount of time that the combustion system 100 can operate within operating constraints (e.g., maintaining a consistent outlet coil temperature) without requiring updates to the predicted trajectory adjustment output values to maintain operation within the operating constraints. The operating time limit may be based on a timer or a time of day (e.g., a real-time clock).

If the MPC optimizer 202 determines that the operating time limit has not expired, the example MPC optimizer 202 continues to check if the operating time limit has expired (block 500) until the time limit expires or until the control system 116 receives an interrupt or an instruction to do otherwise. If the example MPC optimizer 202 determines at block 500 that the operating time limit has expired, control advances to block 502 where the example MPC optimizer 202 obtains a measured product flow for each pass. Such flow measurements correspond to the flow being controlled by each product flow valve (e.g., the valves 120, 122 of FIG. 1). At block 504, the example MPC optimizer 202 calculates a total charge flow. In some examples, the total charge flow corresponds to the combined flow of product flowing through each pass in the heater.

At block 506 of the example method of FIG. 5, the example MPC optimizer 202 obtains a measured outlet temperature for each pass. In some examples, such temperature measurements are obtained from corresponding outlet temperature sensors (e.g., the temperature sensors 144, 146 of FIG. 1). At block 508, the example MPC optimizer 202 calculates a coil outlet temperature. At block 510, the example MPC optimizer 202 obtains a product flow setpoint for each pass. In some examples, the product flow setpoint is calculated via a linear program optimizer associated with the MPC optimizer. In such examples, the linear program optimizer calculates flow for each pass such that the temperature increase in each pass (e.g., the outlet temperature for each pass) is substantially equivalent. That is, the linear program optimizer achieves pass balancing between multiple passes. At block 512, the example MPC optimizer 202 actuates the product flow valves to adjust the product flow for each pass based on the model predictive control. After the example MPC optimizer 202 actuates the product flow valves, control is returned to, for example, a calling function or process such as the example method of FIG. 4.

Figure 6:
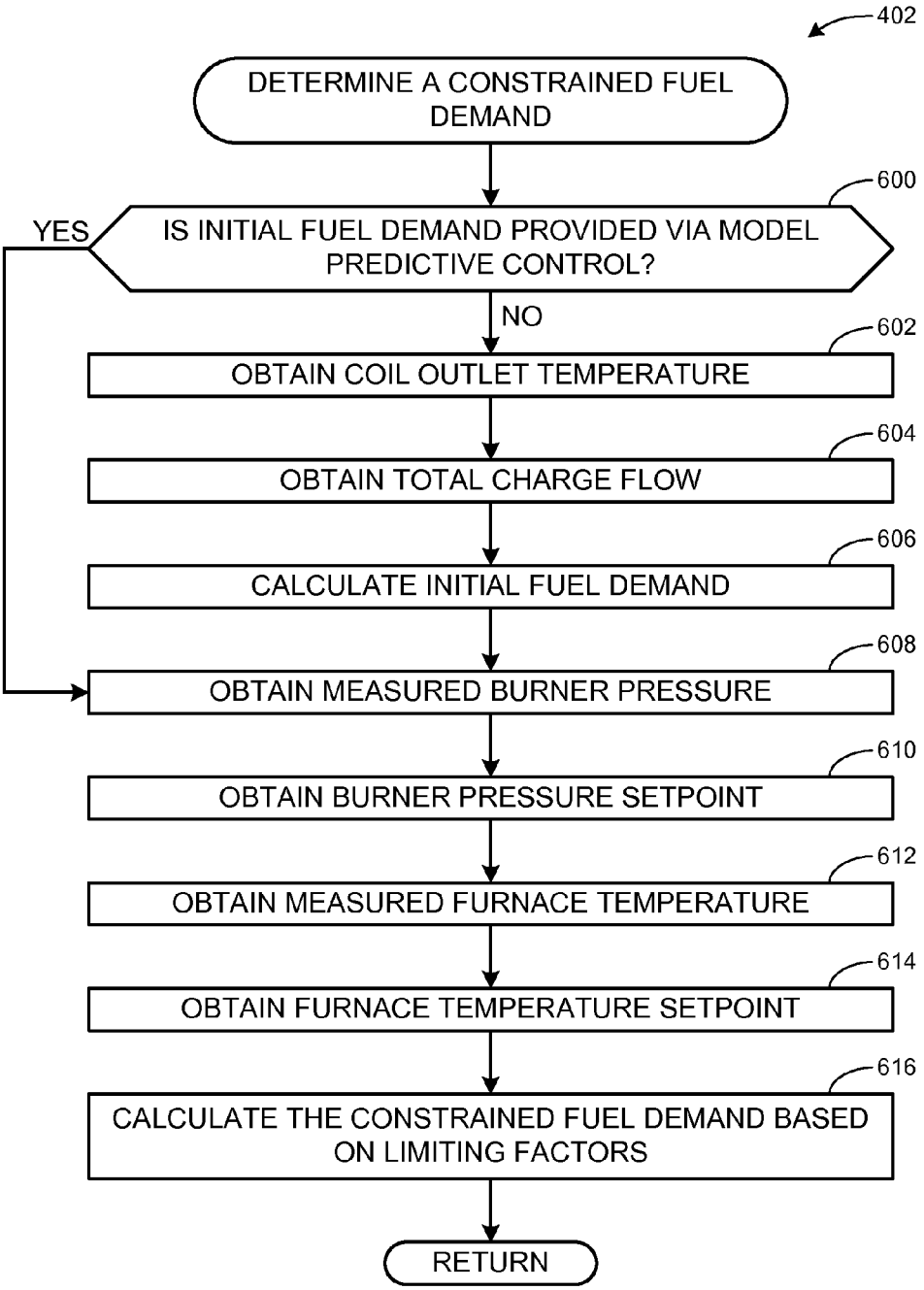

FIG. 6 is a flowchart representative of an example method that may be used to implement the operation of block 402 of FIG. 4 to determine a constrained fuel demand. The example method of FIG. 6 begins at block 600 where the example MPC optimizer 202 determines whether an initial fuel demand is provided via the model predictive control. In addition to using MPC to achieve pass balancing of product feed flowing through separate passes of the heater as described above in connection with FIG. 5, in some examples, MPC also generates an initial or master fuel demand that may be fed into the combustion control process. If such a fuel demand value is provided, calculating the initial fuel demand based on the coil outlet temperature and total charge flow can be bypassed such that control advances to block 608. However, if the MPC optimizer 202 determines that an initial fuel demand is not provided via the model predictive control (block 600), control advances to block 602 where the example MPC optimizer 202 obtains the coil outlet temperature (e.g., based on the coil outlet temperature calculated at block 508 of FIG. 5). At block 604, the example MPC optimizer 202 obtains the total charge flow (e.g., based on the total charge flow calculated at block 504 of FIG. 5). At block 606, the example MPC optimizer 202 calculates an initial fuel demand. In some examples, the initial fuel demand is based on the coil outlet temperature and the total charge flow.

Whether the initial target flow is calculated (block 606) or provided via MPC (block 600), the example method of FIG. 6 advances to block 608 where the example MPC optimizer 202 obtains a measured burner pressure (e.g., via the burner pressure sensor 138 of FIG. 1). At block 610, the example MPC optimizer 202 obtains a burner pressure setpoint. In some examples, the burner pressure setpoint is user specified. At block 612, the example MPC optimizer 202 obtains a measured furnace temperature (e.g., via the furnace temperature sensor 140 of FIG. 1). At block 614, the example MPC optimizer 202 obtains a furnace temperature setpoint. In some examples, the furnace temperature setpoint is user specified.

At block 616, the example MPC optimizer 202 calculates a constrained fuel demand based on limiting factors. In particular, in some examples, the MPC optimizer 202 calculates different fuel demands based on a high burner pressure, a low burner pressure, and the furnace temperature, each of which may be a limiting factor in calculating the constrained fuel demand. In some examples, the low and high burner pressure constraints are compared with the initial fuel demand (e.g., calculated at block 606 or provided via MPC as described at block 600). In such examples, the MPC optimizer 202 predicts a constraint violation and adjusts if necessary and then compares the resulting pressure constrained demand to the furnace temperature constraint. MPC optimizer 202 predicts a constraint violation and adjusts the demand if necessary to a final constrained fuel demand for the cross-limiting calculation. After the example MPC optimizer 202 calculates the constrained fuel demand in this manner, control is returned to, for example, a calling function or process such as the example method of FIG. 4.

Figure 7:
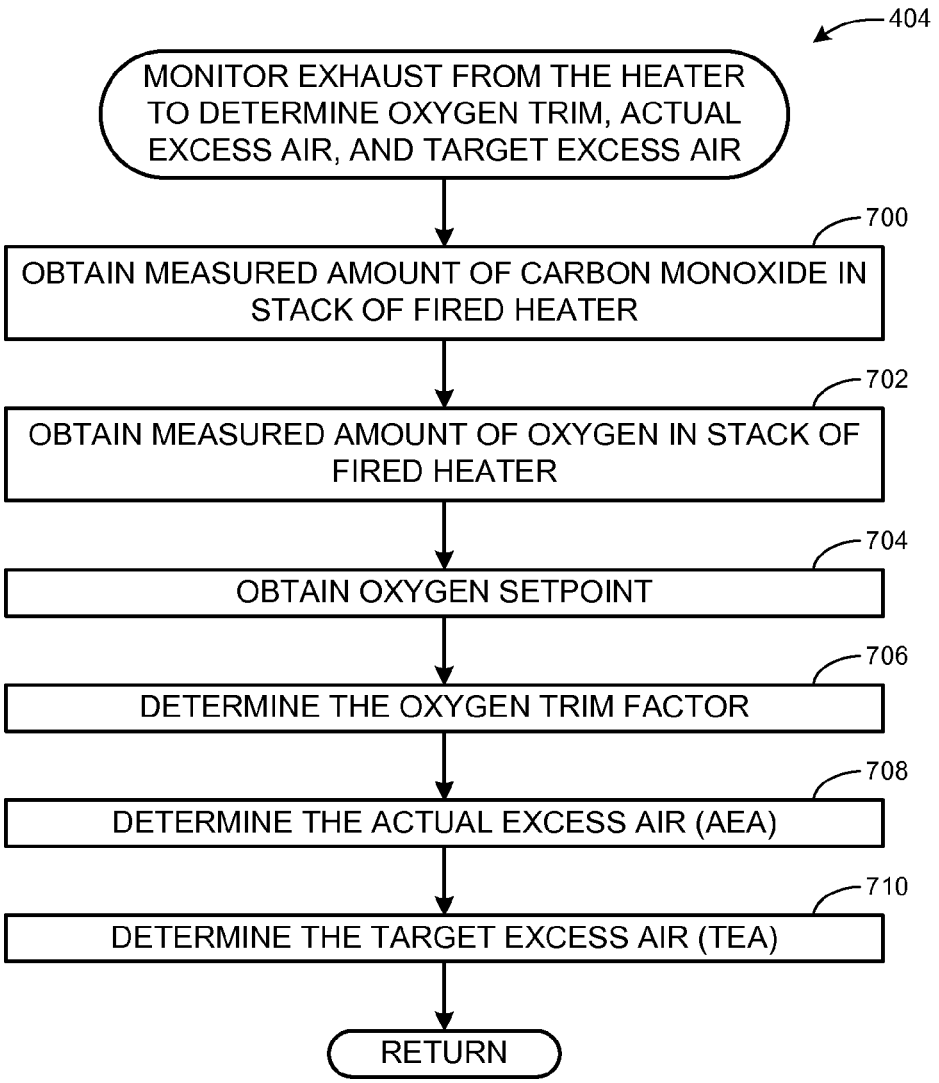

FIG. 7 is a flowchart representative of an example method that may be used to implement the operation of block 404 of FIG. 4 to monitor exhaust from the heater to determine oxygen trim, actual excess air, and target excess air. The example method of FIG. 7 begins at block 700 where the example cross-limiting calculator 204 obtains a measured amount of carbon monoxide in the stack of fired heater (e.g., via the carbon monoxide sensor 128 of FIG. 1). At block 702, the example cross-limiting calculator 204 obtains a measured amount of oxygen in the stack of fired heater (e.g., via the oxygen sensor 126 of FIG. 1).

At block 704, the example cross-limiting calculator 204 obtains an oxygen setpoint. In some examples, the oxygen setpoint is used to calculate an oxygen trim factor. In some examples the oxygen setpoint is based on a user specified base setpoint that is combined with a bias value. In some examples, the bias value is also set by a user. In some examples, the bias value is based on the carbon monoxide measured in the stack of the heater (e.g., at block 700). At block 706, the example cross-limiting calculator 204 determines an oxygen trim factor. As described above, in some examples, the oxygen trim factor is based on the oxygen setpoint (block 704) and the measured amount of oxygen in the stack (block 702). In some examples, the oxygen trim factor is scaled to be between 80% and 120%.

At block 708, the example cross-limiting calculator 204 determines an actual excess air (AEA). In some examples, the AEA is based on the known relationship between oxygen in the stack and excess air in the heater for a given fuel composition. In some examples, the relationships are defined by a curve (e.g., the curve 304 of FIG. 3) corresponding to an assumed composition of the fuel in the combustion process. Thus, the example cross-limiting calculator 204 enters the measured amount of oxygen in the stack (block 702) into the curve to arrive at a resulting excess air, which corresponds to the AEA. At block 710, the example cross-limiting calculator 204 determines a target excess air (TEA). In some examples, the example cross-limiting calculator 204 determines the TEA in the same way as the AEA (e.g., via the curve 304) except that the input oxygen level used is the oxygen setpoint (block 704). After the example cross-limiting calculator 204 determines the oxygen trim factor (block 706), the AEA (block 708), and the TEA (block 710), control is returned to, for example, a calling function or process such as the example method of FIG. 4.

Figure 8:
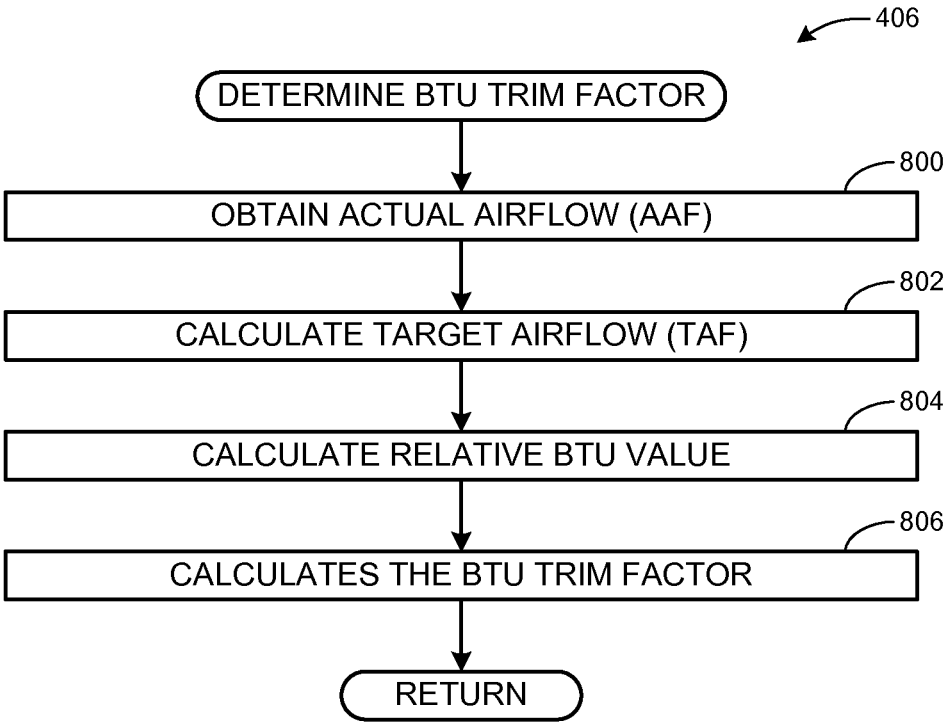

FIG. 8 is a flowchart representative of an example method that may be used to implement the operation of block 406 of FIG. 4 to determine a BTU trim factor. The example method of FIG. 8 begins at block 800 where the example fuel heat release calculator 208 obtains an actual airflow (AAF) (e.g., via the airflow sensor 136 of FIG. 1). At block 802, the example fuel heat release calculator 208 calculates a target airflow (TAF). In some examples, the TAF corresponds to the cross-limited air demand calculated at block 410 of FIG. 4 as described above. However, as described above, in the example methods described herein, the TAF is an input value used in calculating the cross-limited air demand. Thus, the TAF is a feedback input into its own subsequent calculation that adjusts as the example method cycles through multiple iterations. In some examples, the TAF is defined to be equivalent to the AAF as an initial starting point. Once the example method has cycled through the first iteration, all parameters will be known to then calculate a TAF, which may then vary from the AAF, thereby, requiring adjustments to the combustion process.

At block 804, the example fuel heat release calculator 208 calculates a relative heat release value. In some examples, the relative heat release value corresponds to the ratio of actual airflow (block 800) to target airflow (block 802) multiplied by the ratio of target excess air (block 710) to actual excess air (block 708). The relative heat release value is expressed in equation 7 described above. At block 804, the example fuel heat release calculator 208 calculates the BTU trim factor. In some examples, the BTU trim factor has a setpoint of 1 and is determined based on the relative heat release value. In some examples, the BTU trim factor is scaled between 80% and 120%. After the example fuel heat release calculator 208 determines the BTU trim factor, control is returned to, for example, a calling function or process such as the example method of FIG. 4.

Figure 9:
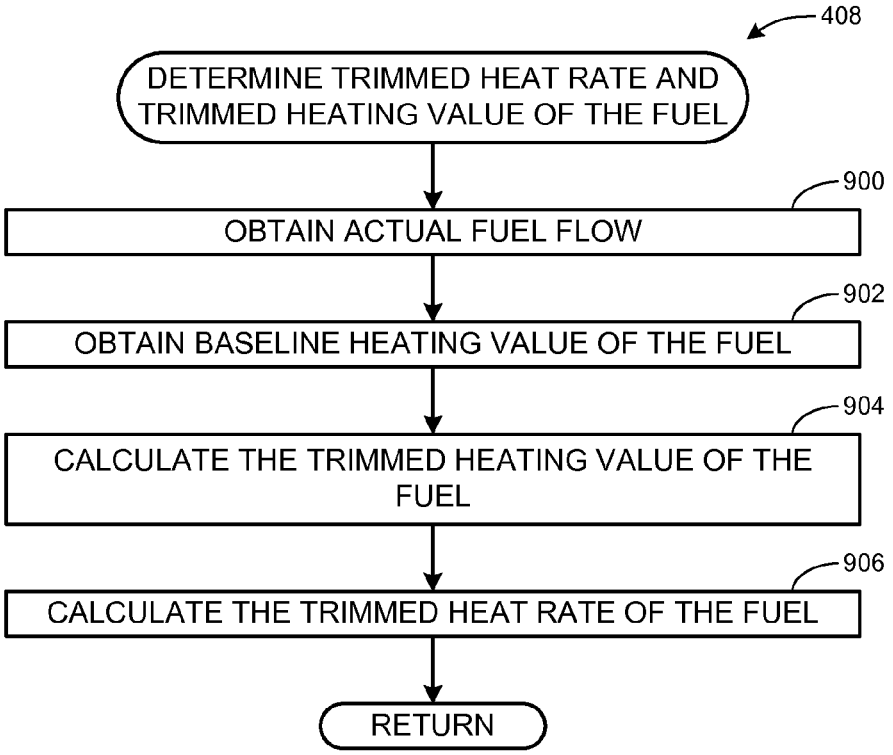

FIG. 9 is a flowchart representative of an example method that may be used to implement the operation of block 408 of FIG. 4 to determine a trimmed heat rate and trimmed heating value of the fuel. The example method of FIG. 9 begins at block 900 where the example fuel heat release calculator 208 obtains the actual fuel flow (e.g., via the fuel temperature and pressure sensors 152, 154 of FIG. 1). At block 902, the example fuel heat release calculator 208 obtains a baseline heating value of the fuel. In some examples, the baseline heating value is an assumed constant value specified by a user corresponding to an assumed composition of the fuel. In other examples, the baseline heating value may be measured (e.g., via the fuel heating value sensor 150). At block 904, the example fuel heat release calculator 208 calculates the trimmed heating value of the fuel. In some examples the trimmed heating value corresponds to the baseline heating value (block 902) multiplied by the BTU trim factor (block 806 of FIG. 8). At block 904, the example fuel heat release calculator 208 calculates the trimmed heat rate of the fuel. In some examples, the trimmed heat rate corresponds to the trimmed heating value of the fuel (block 904) multiplied by the actual fuel flow (block 900). After the example fuel heat release calculator 208 determines the trimmed heating value and trimmed heat rate of the fuel, control is returned to, for example, a calling function or process such as the example method of FIG. 4.

Figure 10:
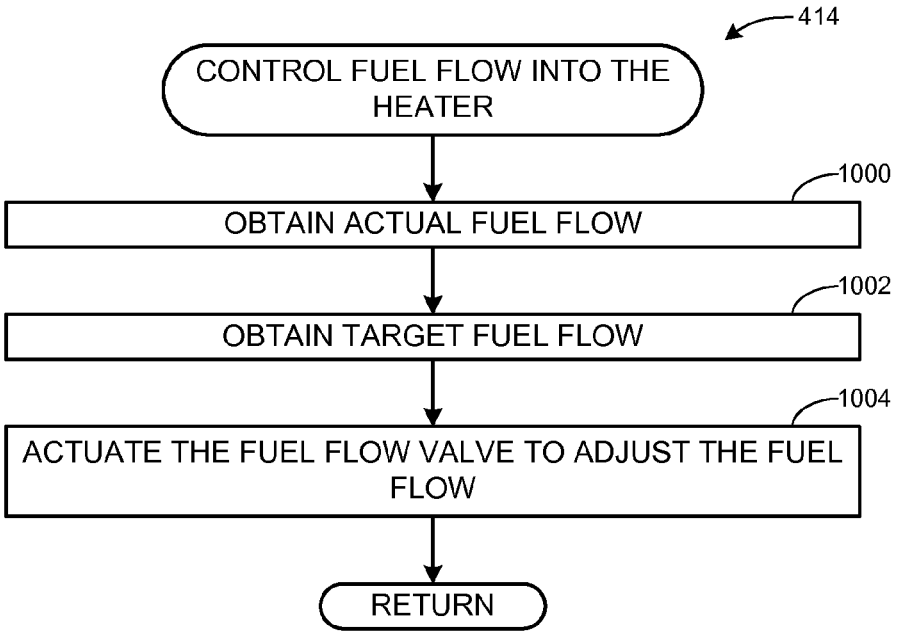

FIG. 10 is a flowchart representative of an example method that may be used to implement the operation of block 414 of FIG. 4 to control a fuel flow into the heater. The example method of FIG. 10 begins at block 1000 where the example fuel flow controller 210 obtains an actual fuel flow (e.g., the fuel flow obtained at block 900 of FIG. 9). At block 1002, the example fuel flow controller 210 obtains a target fuel flow. In the example method of FIG. 9, the target fuel flow corresponds to the cross-limited fuel demand calculated at block 412 of FIG. 4. At block 1004, the example fuel flow controller 210 actuates the fuel flow valve to adjust the fuel flow. After the example fuel flow controller 210 actuates the fuel flow valve, control is returned to, for example, a calling function or process such as the example method of FIG. 4.

Figure 11:
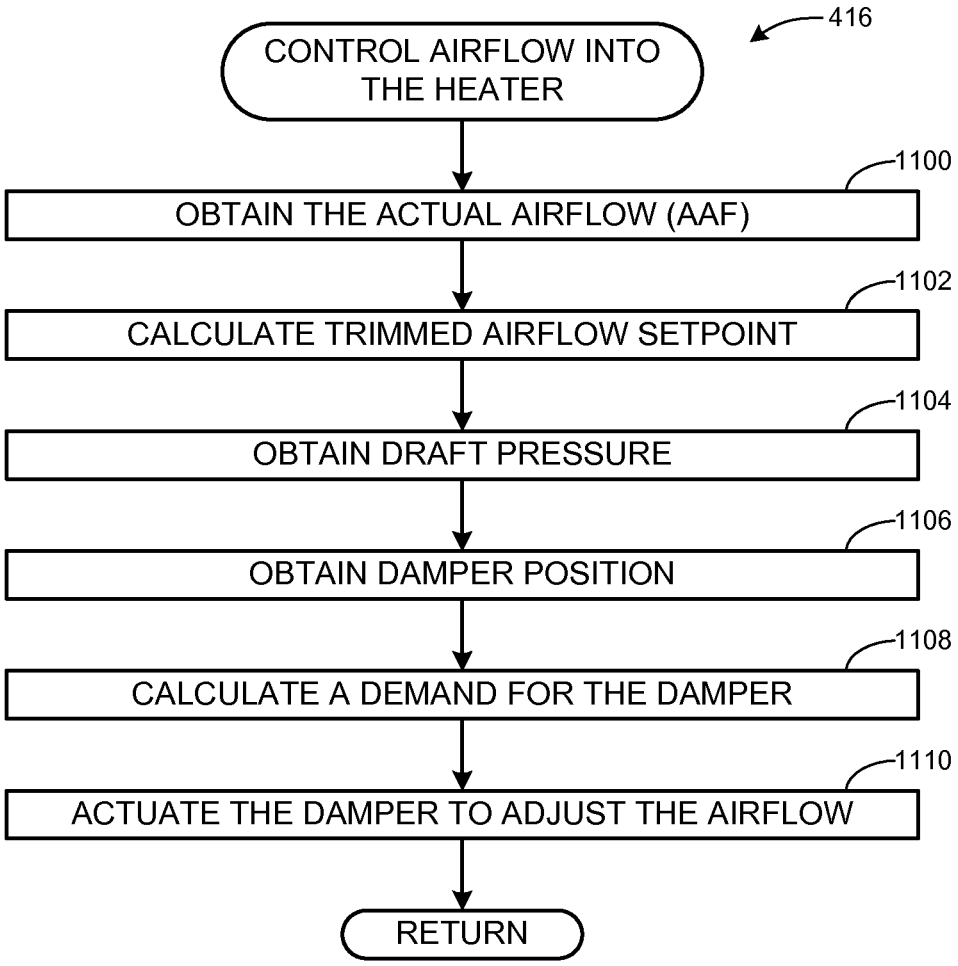

FIG. 11 is a flowchart representative of an example method that may be used to implement the operation of block 416 of FIG. 4 to control an airflow into the heater. The example method of FIG. 11 begins at block 1100 where the example airflow controller 206 obtains an actual airflow (AAF) (e.g., via the airflow sensor 136). In some examples, the AAF corresponds to the AAF obtained at block 800 of FIG. 8. At block 1102, the example airflow controller 206 calculates a trimmed airflow setpoint. In some examples, the trimmed airflow setpoint (or trimmed TAF) corresponds to the target airflow (TAF) (calculated at block 802 of FIG. 8) multiplied by the oxygen trim factor (determined at block 706 of FIG. 7).

At block 1104, the example airflow controller 206 obtains a draft pressure (e.g., via the draft pressure sensor 132). At block 1106, the example airflow controller 206 obtains a damper position (e.g., via the damper position sensor 134). At block 1108, the example airflow controller 206 calculates a demand for the damper. In some examples, the demand for the damper corresponds to the greater of a demand based on the AAF relative to the trimmed airflow setpoint or a demand based on the draft pressure. At block 1110, the example airflow controller 206 actuates the damper to adjust the airflow. After the example airflow controller 206 actuates the damper, control is returned to, for example, a calling function or process such as the example method of FIG. 4.

Figure 12:
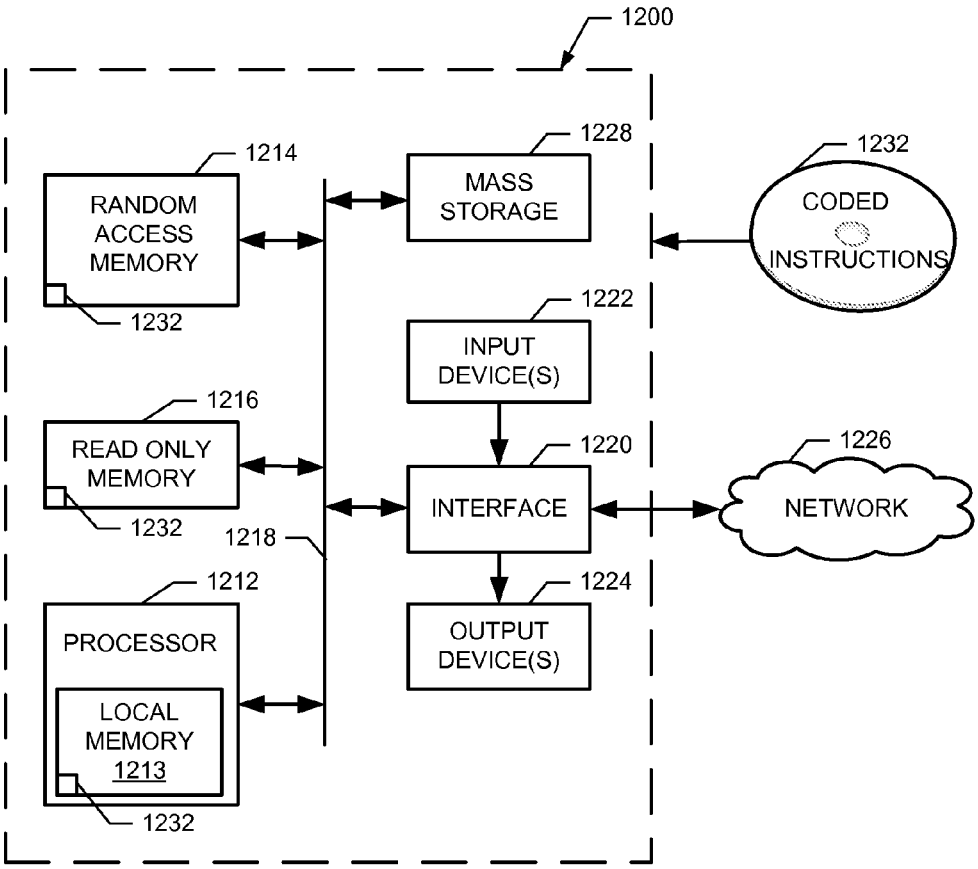
FIG. 12 is a schematic illustration of an example processor platform that may be used and/or programmed to carry out the example process of FIGS. 4-11 and/or, more generally, to implement the example control system of FIGS. 1 and/or 2

FIG. 12 is a block diagram of an example processor platform 1200 capable of executing the instructions of FIGS. 4-11 to implement the control system 116 of FIG. 2. The processor platform 1200 can be, for example, a server, a personal computer, a mobile device (e.g., a cell phone, a smart phone, a tablet such as an iPad™), or any other type of computing device.

The processor platform 1200 of the illustrated example includes a processor 1212. The processor 1212 of the illustrated example is hardware. For example, the processor 1212 can be implemented by one or more integrated circuits, logic circuits, microprocessors or controllers from any desired family or manufacturer.

The processor 1212 of the illustrated example includes a local memory 1212 (e.g., a cache). The processor 1212 of the illustrated example is in communication with a main memory including a volatile memory 1214 and a non-volatile memory 1216 via a bus 1218. The volatile memory 1214 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1216 may be implemented by flash memory and/or any other desired type of memory device. Access to the main memory 1214, 1216 is controlled by a memory controller.

The processor platform 1200 of the illustrated example also includes an interface circuit 1220. The interface circuit 1220 may be implemented by any type of interface standard, such as an Ethernet interface, a universal serial bus (USB), and/or a PCI express interface.

In the illustrated example, one or more input devices 1222 are connected to the interface circuit 1220. The input device(s) 1222 permit(s) a user to enter data and commands into the processor 1212. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1224 are also connected to the interface circuit 1220 of the illustrated example. The output devices 1224 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 1220 of the illustrated example, thus, typically includes a graphics driver card, a graphics driver chip or a graphics driver processor.

The interface circuit 1220 of the illustrated example also includes a communication device such as a transmitter, a receiver, a transceiver, a modem and/or network interface card to facilitate exchange of data with external machines (e.g., computing devices of any kind) via a network 1226 (e.g., an Ethernet connection, a digital subscriber line (DSL), a telephone line, coaxial cable, a cellular telephone system, etc.).

The processor platform 1200 of the illustrated example also includes one or more mass storage devices 1228 for storing software and/or data. Examples of such mass storage devices 1228 include floppy disk drives, hard drive disks, compact disk drives, Blu-ray disk drives, RAID systems, and digital versatile disk (DVD) drives.

Coded instructions 1232 to implement the methods of FIGS. 4-11 may be stored in the mass storage device 1228, in the volatile memory 1214, in the non-volatile memory 1216, and/or on a removable tangible computer readable storage medium such as a CD or DVD.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus comprising:

a sensor to monitor an actual flow of fuel into a combustion process;

a heat release calculator to calculate a relative heat release value corresponding to a change in a heating value of the fuel in the combustion process, the change in the heating value calculated based on a change in a stoichiometric amount of air consumed in the combustion process, the relative heat release value corresponding to the product of a first ratio of an actual airflow of air into the combustion process to a target airflow and a second ratio of a target excess air for the combustion process to an actual excess air; and a cross-limiting calculator to determine a fuel demand for the combustion process based on the relative heat release value.

2. The apparatus of claim 1, further comprising an airflow sensor to monitor the actual airflow of air into the combustion process, the fuel demand for the combustion process to be based on the actual airflow, the cross-limiting calculator to determine the target airflow for the combustion process based on the greater of the actual flow of the fuel or the fuel demand.

3. The apparatus of claim 1, further comprising:

an oxygen sensor to monitor an amount of oxygen in an exhaust of the combustion process; and a controller to determine the actual excess air based on the amount of oxygen in the exhaust of the combustion process and to determine the target excess air based on an oxygen setpoint indicative of a desired amount of oxygen in the exhaust of the combustion process.

4. The apparatus of claim 3, further comprising a carbon monoxide sensor to monitor an amount of carbon monoxide in the exhaust of the combustion process, the oxygen setpoint to be based on the amount of carbon monoxide.

5. The apparatus of claim 1, wherein the fuel has an unknown composition that varies over time.

6. The apparatus of claim 1, wherein the heat release calculator is to:

determine a BTU trim factor based on the relative heat release value; and calculate a trimmed heating value for the fuel, the fuel demand to be based on the trimmed heating value.

7. The apparatus of claim 1, wherein a composition of the fuel is uncontrolled.

8. The apparatus of claim 5, wherein the target airflow is adjusted in real time based on the variation of the composition of the fuel.

9. The apparatus of claim 1, wherein the relative heat release value is determined in substantially real-time without sampling the fuel.

10. The apparatus of claim 1, further comprising a controller to determine the target excess air for the combustion process and the actual excess air in the combustion process, the relative heat release value to be based on the target airflow, the actual airflow, the target excess air, and the actual excess air.

11. The apparatus of claim 1, wherein the actual airflow of air into the combustion process is measured by an airflow sensor, the target airflow based on the greater of the actual flow of the fuel or the fuel demand, the actual excess air based on an amount of oxygen in an exhaust of the combustion process measured by an oxygen sensor, the target excess air for the combustion process based on an oxygen setpoint indicative of a desired amount of oxygen in the exhaust of the combustion process.

* * * * *